US010907826B2

(12) United States Patent
Andersen

(10) Patent No.: US 10,907,826 B2
(45) Date of Patent: Feb. 2, 2021

(54) GAS TORCH WITH FLAME DIVERTERS

(71) Applicant: Sean Andersen, Phoenix, AZ (US)

(72) Inventor: Sean Andersen, Phoenix, AZ (US)

( * ) Notice: Subject to any disclaimer, the term of this patent is extended or adjusted under 35 U.S.C. 154(b) by 159 days.

(21) Appl. No.: 16/195,407

(22) Filed: Nov. 19, 2018

(65) Prior Publication Data

US 2019/0257517 A1 Aug. 22, 2019

Related U.S. Application Data

(60) Provisional application No. 62/632,377, filed on Feb. 19, 2018.

(51) Int. Cl.

| | |
|---|---|
| ***F21L 17/00*** | (2006.01) |
| ***F23D 14/30*** | (2006.01) |
| ***F23D 14/58*** | (2006.01) |

(52) U.S. Cl.

CPC ..... *F23D 14/30* (2013.01); *F21L 17/00* (2013.01); *F23D 14/58* (2013.01); *F23D 2206/0094* (2013.01)

(58) Field of Classification Search

CPC ..... F23D 14/30

USPC ..... 431/263, 109, 353

See application file for complete search history.

(56) References Cited

U.S. PATENT DOCUMENTS

| | | | | | |
|---|---|---|---|---|---|
| 2,417,152 | A * | 3/1947 | Collins | E21B 43/088 | 166/233 |
| 3,018,823 | A * | 1/1962 | Alger | F23D 14/84 | 239/500 |
| 3,088,271 | A * | 5/1963 | Smith | F01N 3/26 | 422/177 |
| 3,663,154 | A * | 5/1972 | Locke | F04F 5/466 | 431/353 |
| 4,013,395 | A * | 3/1977 | Wormser | F23D 14/34 | 431/9 |
| 4,886,447 | A * | 12/1989 | Goss | F23D 14/38 | 431/353 |
| 6,162,046 | A * | 12/2000 | Young | F23D 3/02 | 126/45 |
| 2013/0252188 | A1* | 9/2013 | Chen | F23D 14/06 | 431/353 |
| 2015/0192293 | A1* | 7/2015 | Buden | F23D 14/58 | 431/354 |

* cited by examiner

*Primary Examiner* — Avinash A Savani
(74) *Attorney, Agent, or Firm* — Parsons & Goltry; Robert Parsons; Michael Goltry

(57) ABSTRACT

A gas torch includes a base couplable to a gas source supplying gaseous fuel and gas ports formed in a top surface of the base to emit gas upwardly therefrom. A plurality of diverters is stacked in a spaced apart relationship directly above the base, each diverter having an inner edge and an outer edge. Each diverter is positioned above a lower diverter so that the inner edge and the outer edge are positioned intermediate one of the inner edge and the outer edge of the lower diverter. The lowest diverter, that which is adjacent the base, is positioned such that the gas ports are positioned directly underlying and intermediate the inner edge and the outer edge thereof.

17 Claims, 4 Drawing Sheets

GAS TORCH WITH FLAME DIVERTERS

CROSS-REFERENCE TO RELATED APPLICATIONS

This application claims the benefit of U.S. Provisional Patent Application No. 62/632,377, filed 19 Feb. 2018.

FIELD OF THE INVENTION

This invention relates to torches.

More particularly, the present invention relates to gas torches with diverted flames.

BACKGROUND OF THE INVENTION

In the field of outdoor garden torches (commonly called tiki torches) two main types are prevalent and can be classified as either kerosene or gas fueled. There are advantages and disadvantages to each type. Kerosene type torches utilize either kerosene, citronella, or an outdoor lamp oil for combustible fuel. The torch will typically act as the reservoir for the fuel, and employs a wick in contact with the fuel. The wick draws fuel from the reservoir and is lit to produce a flame. Cost and flexibility are the primary advantages to this type of torch. The kerosene torch can be carried and placed where desired, and can be easily moved to a new location. Although kerosene torches are typically less expensive than gas torches to begin with, the savings are really found in the installation.

A gas torch is desirable for primarily two reasons: performance and maintenance. Propane or natural gas is delivered to the head of a gas torch at a certain pressure, which allows the flame to be higher and more brilliant than that of a kerosene type torch. In addition, a kerosene type torches flame height is dictated by how much fuel is physically present and consumed by the exposed wick above the uppermost fitting. The type and material of the wick is also determinative of the size, durability and brightness of as generated flame. Maintenance and replacement of a wicks is a constant chore with kerosene type torches. In contrast, natural and propane gas tiki torches do not need this same type of attention. The torch's flame is a consistent height for the entire operating time, a group of torches can be turned off with the use of a master valve, and long-term maintenance, similar to that of a propane grill, is limited to keeping the torch's orifice and burner free from debris. Due to the need for gas lines to the gas torch, installation is more expensive and disruptive to existing landscaping. While each has its benefits, each are limited to a brighter higher or dimmer and lower flame. Often the torch head itself is decorated to provide an interesting or visually pleasing aspect. The flame produced is ordinary consistent and common throughout the different torches.

It would be highly advantageous, therefore, to remedy the foregoing and other deficiencies inherent in the prior art.

An object of the present invention is to provide an new gas torch with decorative flame.

Another object of the present invention is to provide a gas torch providing a shaped flame.

SUMMARY OF THE INVENTION

Briefly, to achieve the desired objects and advantages of the instant invention provided is a gas torch with flame shaping elements. The gas torch includes a base couplable to a gas source supplying gaseous fuel and gas ports formed in a top surface of the base to emit gas upwardly therefrom. A plurality of diverters is stacked in a spaced apart relationship directly above the base, each diverter having an inner edge and an outer edge. Each diverter is positioned above a lower diverter so that the inner edge and the outer edge are positioned intermediate one of the inner edge and the outer edge of the lower diverter. The lowest diverter, that which is adjacent the base, is positioned such that the gas ports are positioned directly underlying and intermediate the inner edge and the outer edge thereof.

In a specific aspect, a first diverter having a first edge and a second edge, is positioned overlying and spaced from the gas ports, such that the gas ports are positioned directly below and intermediate the first edge and the second edge. A second diverter having a first edge and a second edge, is positioned overlying and spaced from the first diverter such that one of the first edge of the first diverter and the second edge of the first diverter is positioned directly below and intermediate the first edge of the second diverter and the second edge of the second diverter.

In another aspect, the first diverter and the second diverter are either circular or non-circular rings.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
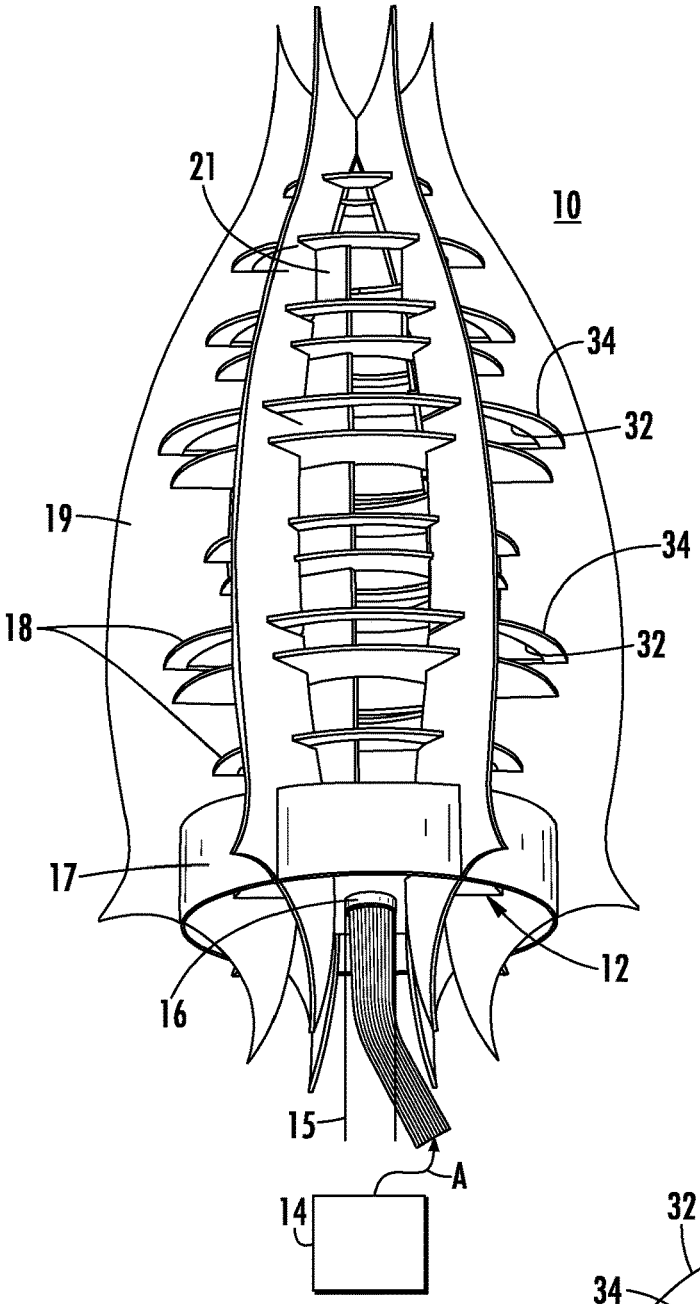
FIG. 1 is a perspective side view of a gas torch according to the present invention.
Figure 2:
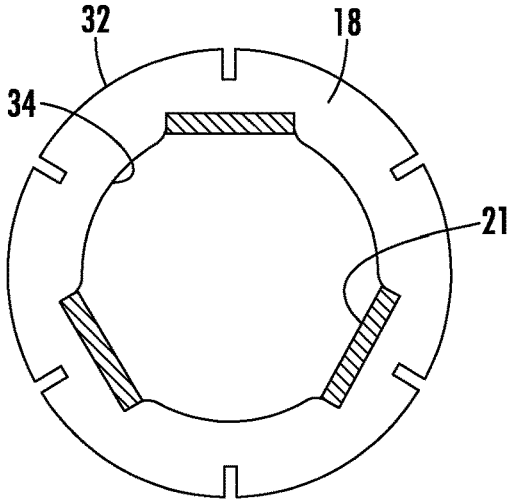
FIG. 2 is a partial top sectional view of the gas torch of FIG. 1.

Turning now to the drawings in which like reference characters indicate corresponding elements throughout the several views, attention is directed to FIGS. 1 and 2 which illustrates a gas torch generally designated 10. Gas torch 10 includes a base 12 couplable to a gas source 14 supplying gaseous fuel such as propane, natural gas, aerosolized fuel and the like. It will be understood that while gaseous fuels are preferred, liquid fuels such as kerosene can also be used as the fluid can be aerosolized as it is injected upwards through base 12. Base 12 is preferably mounted to a post 15, supporting gas torch 10, and includes a gas conduit 16 providing a gas flow to base 12 from source 14, as indicated by arrowed line A. A shield element 17 is positioned around base 12 and spaced therefrom to prevent distortion of gaseous fuel emitted from base 12 by errant breezes and disturbed air. Diverter members 18 are positioned above base 12 for diverting ignited and unignited gaseous fuel flow from base 12, providing a curling thereof for visual effect.

Diverter members 18 are positioned and secured by support members 19 extending upwardly from base 12 outside of diverter member 18 and chimney elements 21 extending upwardly inside of diverters 18. Chimney elements 21 define an interior column above base 12. The interior column concentrates flames and heat. The temperature inside the interior column is higher than the temperature outside, drawing colder air from outside into the interior column. The gaps between chimney elements 21 allow air to enter and flames to escape to interact with the diverter members 18. Gas torch 10 is preferably made of metal such as steel, stainless steel, iron, aluminum, copper, brass and the like, with the elements joined such as by welding, tacking, clipping bolting, riveting and the like.

Figure 3:
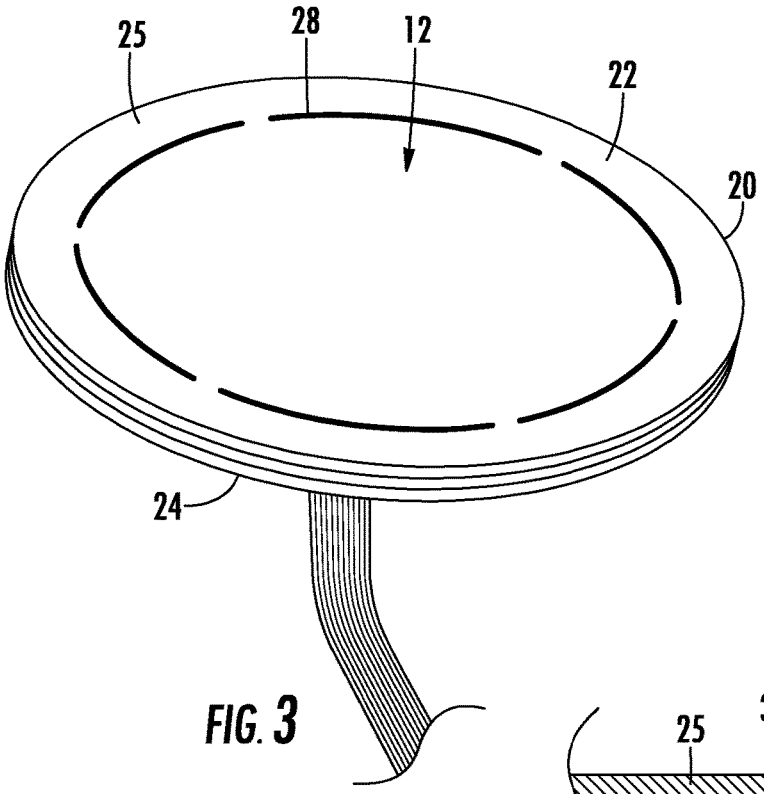
FIG. 3 is a perspective view of a base of the torch of FIG. 1.
Figure 4:
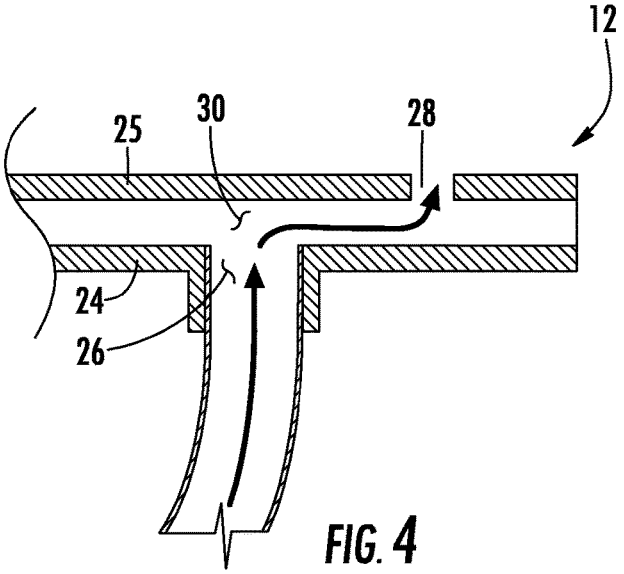
FIG. 4 is a partial sectional side view of the base of the torch of FIG. 1.

With additional reference to FIGS. 3 and 4, in this embodiment, base 12 is circular in shape having an outer edge 20, and a generally planar top surface 22. While circular in this preferred embodiment, base 12 can be made in other shapes such as square, triangular, oval and the like. Base 12 is formed of a bottom plate 24 and a top plate 25. Bottom plate 24 is coupled to tubular post 15 and includes a central aperture 26 formed therethrough and coupled to fuel conduit 16 for receiving a flammable gas therethrough as illustrated by arrowed lines B. Top plate 25 includes gas ports for emitting gaseous fuel, which in the preferred embodiment includes a plurality of slots 28 formed therethrough in a circular pattern spaced from outer edge 20 and encircling aperture 26. A volume 30 is defined between bottom plate 24 and top plate 25, which acts as a manifold receiving the gaseous fuel from fuel conduit 16 through aperture 26 and dispersing the gaseous fuel generally evenly through slots 28. Slots 28 are intended to allow egress of gaseous fuel from volume 30 in a homogenous manner. One skilled in the art will understand that while slots are preferred, other aperture shapes may be employed as gas ports to distribute gaseous fuel from volume 30. Thus, the gaseous fuel comes in through aperture 26 and is expelled through slots 28 of base 12.

Still referring to FIGS. 1 and 2, diverter members 18 are rings in this preferred embodiment. While annular rings are used in the preferred embodiment, it will be understood that the term "ring" as used herein is intended to include both circular and non-circular shapes, including square, triangular, oval, square and the like. Diverters are stacked in a spaced apart relationship directly above base 12. Each diverter has an inner edge 32 and an outer edge 34. The distance between inner edge 32 and outer edge 34 can vary between the different diverter members 18. Providing diverters 18 having different widths allows for variety in design and flame paths. Regardless of the width, each diverter is positioned above a lower diverter 18 so that the inner edge 32 and the outer edge 34 are positioned intermediate one of the inner edge 32 and the outer edge 34 of the lower diverter. The lowest diverter 18, that which is adjacent base 12, is positioned such that slots 28 are positioned underlying and intermediate the inner edge 32 and the outer edge 34.

Figure 5:
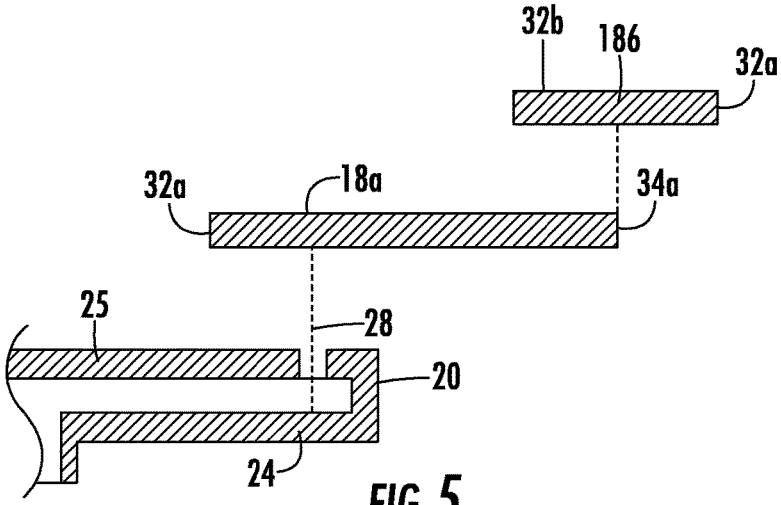
FIG. 5 is a partial sectional side view of the torch of FIG. 1.

Referring specifically to FIG. 5, an example of this arrangement is illustrated. A cross-sectional portion of base 12 is illustrated with slot 28 spaced from edge 20. A diverter 18 consisting of a first ring 18*a*, having an inner edge 32*a* and an outer edge 34*a*, is positioned above base 12 with slot 28 positioned intermediate inner edge 32*a* and outer edge 34*a*. Thus, a portion of first ring 18*a* extends radially inwardly over slot 28 and a portion of ring 18*a* extends radially outwardly from slot 28. With this configuration, ignited and unignited gaseous fuel exiting slot 28 and moving upwardly is divided by first ring 18*a* with gaseous fuel moving inwardly of inner edge 32*a* and outwardly of outer edge 34*a*. In the example illustrated, the portion of ring 18*a* extending inwardly is less than the portion of ring 18*a* extending outwardly. This results in more gas being diverted inwardly than outwardly. One skilled in the art will understand that diverter 18*a* can be positioning with a greater or lesser portion thereof extending radially inwardly from slot 28 and extending radially outwardly from slot 28. The positioning of these portions with respect to slots 28 will determine the quantity of ignited and unignited gaseous fuel moving inwardly and outwardly of diverter 18*a*.

A diverter 18, consisting of a second ring 18*b* having an inner edge 32*b* and an outer edge 34*b*, is positioned above first ring 18*a* with outer edge 34*a* positioned intermediate inner edge 32*b* and outer edge 34*b* of second ring 18*b*. Thus, a portion of second ring 18*b* extends radially inwardly from outer edge 34*a* and a portion of ring 18*b* extends radially outwardly from outer edge 34*a*. With this configuration, the portion of ignited and unignited gaseous fuel flowing outwardly of outer edge 34*a* is again divided by second ring 18*b*. In this example, the radially inwardly and radially outwardly directed portions of ring 18*b* are equal. With this configuration, the portion of gaseous fuel flowing outwardly of outer edge 34*a* is divided generally evenly by second ring 18*b*. It will be understood that multiple additional layers of diverters 18 can be employed, and can be positioned to divert gaseous fuel outwardly in this manner. Furthermore, second ring 18*b* or additional diverters 18 can be positioned above first ring 18*a* (or subsequent rings) with inner edge 32*a* positioned intermediate inner edge 32*b* and outer edge 34*b* of second ring 18*b*. Thus, a portion of second ring 18*b* extends radially inwardly from inner edge 32*a* and a portion of ring 18*a* extends radially outwardly from inner edge 32*a*. With this configuration, the portion of gaseous fuel flowing inwardly of inner edge 32*a* is again divided by second ring 18*b*. It will be understood that multiple additional layers of diverters 18 can be employed, and can be positioned to divert gaseous fuel inwardly and outwardly in this manner. As can be seen, by employing multiple diverters 18, unignited and ignited gaseous fuel emitted upwardly from slots 28 of base 12 can be directed inwardly or outwardly as desired to cause a desired flame pattern from the burning gaseous fuel. Thus, the flames will be diverted inside and outside the rings, causing a curling and flowing effect. As with diverter 18*a*, one skilled in the art will understand that diverter 18*b*, and subsequent diverters, can be positioning with a greater or lesser portion thereof extending radially inwardly from the inner or outer edge of an underlying diverter and extending radially outwardly from the inner or outer edge of an underlying diverter. The positioning of these portions with respect to underlying diverters will determine the quantity of ignited and unignited gaseous fuel moving inwardly and outwardly.

In the preferred embodiment, each subsequent diverter 18 is positioned with substantially equal portions thereof extending inwardly and outwardly from the inner edge or outer edge of the underlying diverter. By providing equal portions, the ignited and unignited gaseous fuel received from the underlying edge will be substantially equally divided. It will also insure that sufficient ignited and unignited fuel remains within the interior column defined by chimney elements 21 to carry upwardly through the entire torch structure. This effect can also be accomplished with shapes other than circular for base 12 and diverters 18. Base 12 can be, for example, oval, triangular, square, a linear shape such as serpentine or straight line and the like, or other desired shapes. Diverters 18 can also have different shapes, being rings of different shape, partial rings, such as two sides of a triangle, or linear and curved shapes as long as an inner or outer edge of an underlying diverter is positioned intermediate the inner and outer edges of an overlying diverter. Thus, regardless of the shape, the diverters can be positioned to divert portions of the ignited and unignited gaseous fuel into desired pathways to produce a desirable visual effect.

Figure 6:
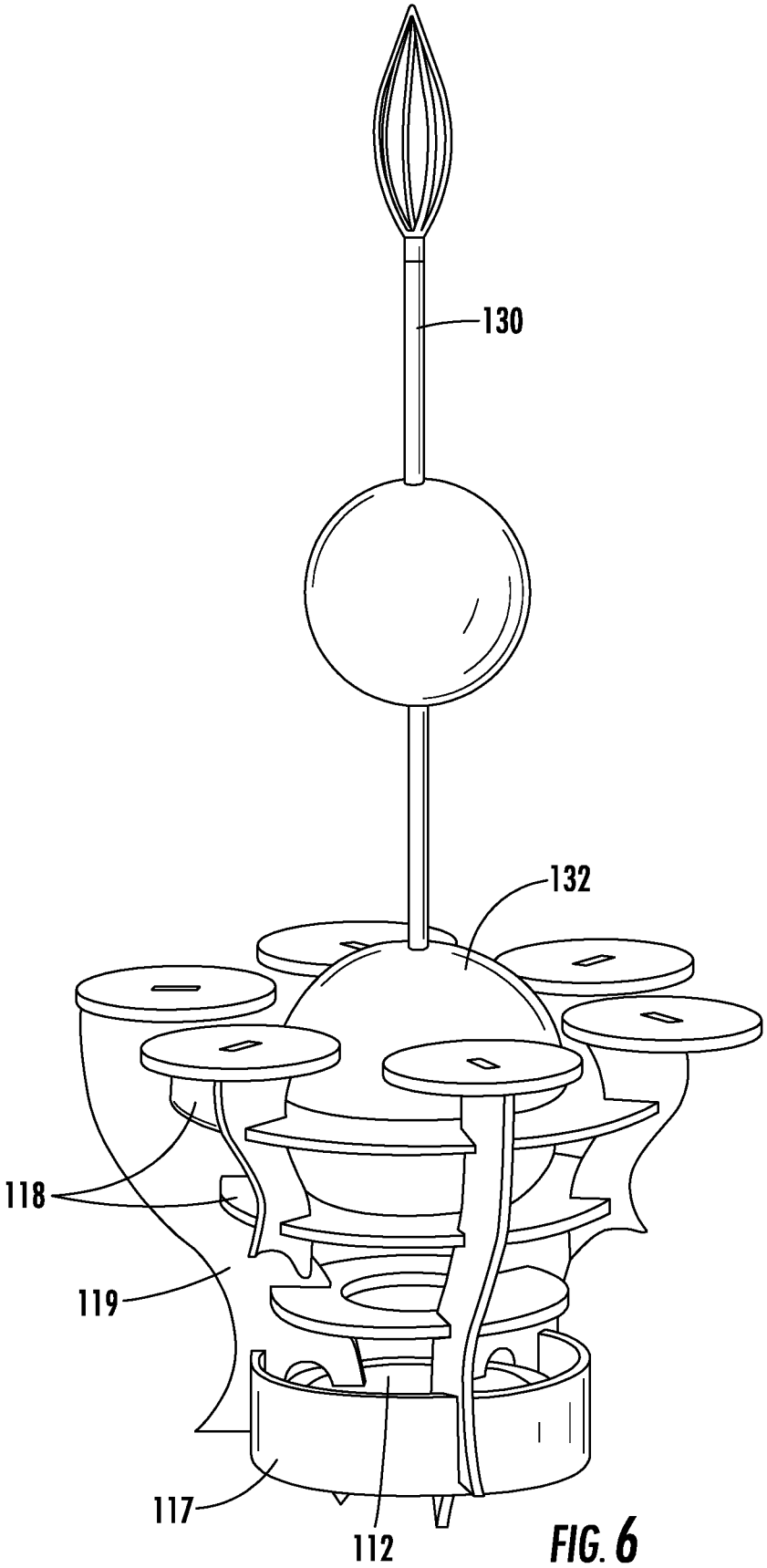
FIG. 6 is a perspective view of another embodiment of a torch according to the present invention.

Turning now to FIG. 6, another embodiment of a gas torch generally designated 110 is illustrated. Torch 110 is substantial similar to gas torch 10, in that it includes a base 112, a shield element 117, diverters 118 and support members 119 functioning in an identical manner. Additionally, a centrally positioned rod 130 extends upwardly from base 112. A spherical element 132 is slidably carried by rod 130, and movable between a raised position and a lowered position. Spherical element 132 is illustrated in a lowered position nested on diverters 118. In this position, gaseous fuel is primarily directed outwardly of diverters 118. When spherical element 132 is in the raised position, gas can be diverted inwardly by diverters 118 as previously described. As the spherical element is moved toward the lowered position, more and more ignited an unignited gaseous fuel and flames are forced outwardly.

Figure 7:
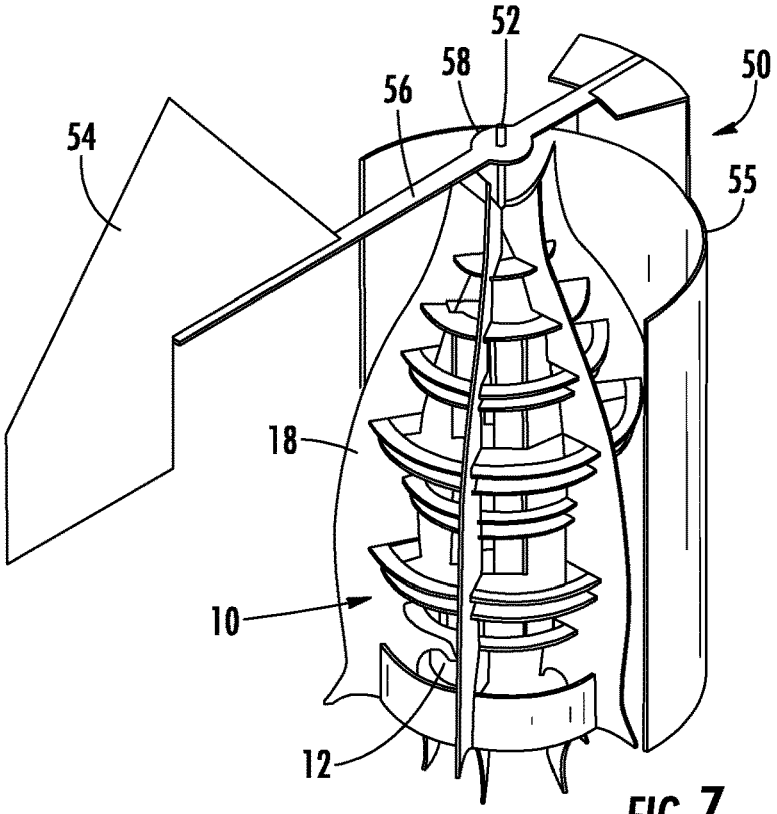
FIG. 7 is a perspective view of the gas torch with wind shield according to the present invention.
Figure 8:
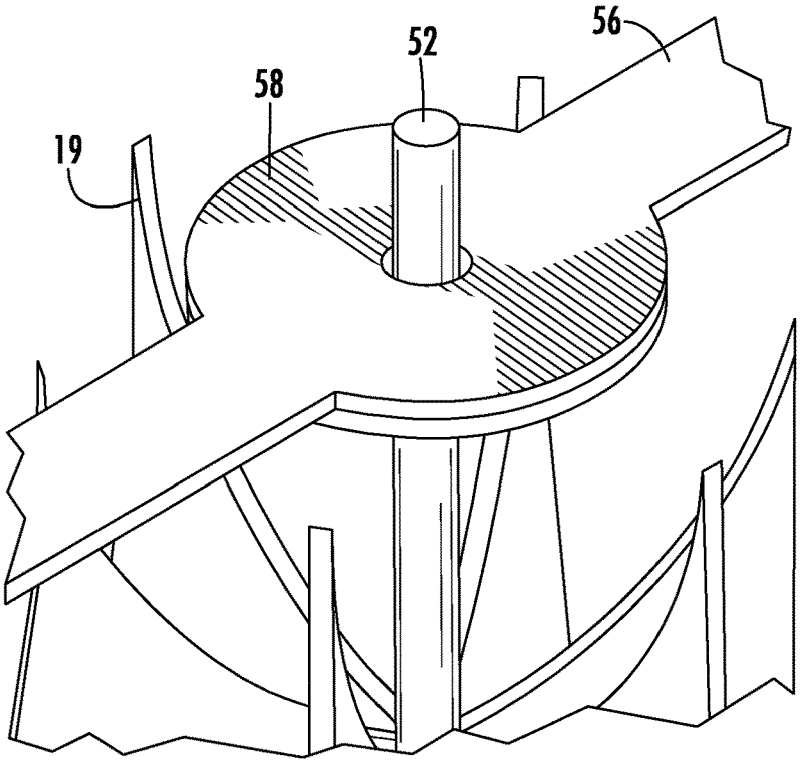
FIG. 8 is an enlarge view of a portion of the shield coupled to the gas torch.

Turning now to FIGS. 7 and 8, a shield 50 is fitted to gas torch 10. Shield 50 is rotatably mounted to torch 10 on a shaft 52 extending upwardly from the top thereof. Shaft 52 extends from a longitudinal axis of torch 10, establishing a rotational axis for shield 50. Shield 50 includes a wind vane 54, a semi-cylindrical wind shield portion 55, and an elongated member 56 coupling wind vane 54 in a spaced apart relationship with wind shield portion 55. A fixture 58 is positioned on elongated member 56 intermediate wind vane 54 and wind shield portion 55. Fixture 58 receives shaft 52 therein allowing for 360 degrees of rotation. Shield portion 55 cups around a portion of the side of torch 10, extending generally from base 12 to the top of support members 19. Wind vane catches cross winds blowing by torch 10 and swing in a conventional weather vane manner to point directly downwind. Shield portion 55 covers a portion of torch 10, opposite wind vane 54, thereby protecting and blocking torch 10 from wind and allowing flames to flow within torch 10 as desired.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A Gas torch with flame shaping elements comprising:
- a base couplable to a gas source supplying gaseous fuel;
- a gas conduit coupling the gas source to the base;
- a gas port formed in a top surface of the base to emit gas upwardly therefrom;
- a first diverter having a first edge and a second edge, the first diverter positioned overlying and spaced from the gas port, such that the gas port is positioned directly below and intermediate the first edge and the second edge of the first diverter; and
- a second diverter having a first edge and a second edge, the second diverter positioned overlying and spaced from the first diverter such that one of the first edge of the first diverter and the second edge of the first diverter is positioned directly below and intermediate the first edge of the second diverter and the second edge of the second diverter.

2. A Gas torch with flame shaping elements as claimed in claim 1 further comprising:
- support members extending upwardly from the base outside of the first diverter member and the second diverter member; and
- chimney elements extending upwardly inside of the first diverter member and the second diverter member, wherein the Chimney elements define an interior column above the base.

3. A Gas torch with flame shaping elements as claimed in claim 1 further comprising a shield element positioned around the base and spaced therefrom to prevent inadvertent distortion of gaseous fuel emitted from the base.

4. A Gas torch with flame shaping elements as claimed in claim 1 wherein the base further comprises:
- a bottom plate having an aperture therethrough;
- a top plate having the gas port formed therein for emitting gaseous fuel; and
- a volume defined between the bottom plate and the top plate acting as a manifold for receiving the gaseous fuel from the fuel conduit through the aperture and dispersing the gaseous fuel generally evenly through the gas port.

5. A Gas torch with flame shaping elements as claimed in claim 4 wherein the gas port includes a plurality of slots formed through the top plate in a circular pattern.

6. A Gas torch with flame shaping elements as claimed in claim 1 further comprising:
- a centrally positioned rod extending upwardly from the base through the interior column; and
- a spherical element slidably carried by the rod and movable between a raised position and a lowered position.

7. A Gas torch with flame shaping elements as claimed in claim 1 further comprising:
- a shaft extending upwardly along a longitudinal axis of the gas torch;
- a shield having a top;
- an elongated member having a first end coupled to the top and a second end;
- a wind vane coupled to the second end of the elongated member in a spaced apart relationship with the shield; and
- a fixture positioned on the elongated member intermediate the wind vane and the shield to rotatably receive the shaft therein, allowing for 360 degrees of rotation of the shield around the outside of the first diverter member and the second diverter member.

8. A Gas torch with flame shaping elements as claimed in claim 1 wherein the first diverter and the second diverter are one of circular and non-circular rings.

9. A Gas torch with flame shaping elements comprising:
- a base coupled to a gas source supplying gaseous fuel by a gas conduit;
- gas ports formed in a top surface of the base in a ring-shaped pattern to emit gas upwardly therefrom;
- a shield element positioned around the base and spaced therefrom to prevent inadvertent distortion of gaseous fuel emitted from the base;
- a first diverter having a ring shape with an inner edge and an outer edge, the first diverter positioned overlying and spaced from the gas port, such that the gas port is positioned directly below and intermediate the inner edge and the outer edge of the first diverter;

a second diverter having an inner edge and an outer edge, the second diverter positioned overlying and spaced from the first diverter such that one of the inner edge of the first diverter and the outer edge of the first diverter is positioned directly below and intermediate the inner edge of the second diverter and the outer edge of the second diverter;

support members extending upwardly from the base outside of and supporting the first diverter member and the second diverter member; and chimney elements extending upwardly inside of and supporting the first diverter member and the second diverter member, wherein the chimney elements define an interior column above the base.

10. A Gas torch with flame shaping elements as claimed in claim 9 wherein the base further comprises:

a bottom plate having an aperture therethrough;

a top plate having the gas ports formed therein for emitting gaseous fuel; and a volume defined between the bottom plate and the top plate acting as a manifold for receiving the gaseous fuel from the fuel conduit through the aperture and dispersing the gaseous fuel generally evenly through the gas ports.

11. A Gas torch with flame shaping elements as claimed in claim 9 further comprising:

a centrally positioned rod extending upwardly from the base through the interior column; and a spherical element slidably carried by the rod and movable between a raised position and a lowered position.

12. A Gas torch with flame shaping elements as claimed in claim 9 further comprising:

a shaft extending upwardly along a longitudinal axis of the gas torch;

a shield having a top;

an elongated member having a first end coupled to the top and a second end;

a wind vane coupled to the second end of the elongated member in a spaced apart relationship with the shield; and a fixture positioned on the elongated member intermediate the wind vane and the shield to rotatably receive the shaft therein, allowing for 360 degrees of rotation of the shield around the outside of the support members.

13. A Gas torch with flame shaping elements as claimed in claim 9 wherein the first diverter and the second diverter are one of circular and non-circular rings.

14. A Gas torch with flame shaping elements comprising:

a base couplable to a gas source supplying gaseous fuel;

gas ports formed in a top surface of the base to emit gas upwardly therefrom;

a plurality of diverters stacked in a spaced apart relationship directly above the base, each diverter having an inner edge and an outer edge, each diverter positioned above a lower diverter so that the inner edge and the outer edge are positioned intermediate one of the inner edge and the outer edge of the lower diverter, the lowest diverter, that which is adjacent the base, is positioned such that the gas ports are positioned directly underlying and intermediate the inner edge and the outer edge, wherein the plurality of diverters are each one of circular and non-circular rings.

15. A Gas torch with flame shaping elements as claimed in claim 14 further comprising:

support members extending upwardly from the base outside of the plurality of diverters; and chimney elements extending upwardly inside of the plurality of diverters, wherein the Chimney elements define an interior column above the base.

16. A Gas torch with flame shaping elements as claimed in claim 15 further comprising a shield element positioned around the base and spaced therefrom to prevent inadvertent distortion of gaseous fuel emitted from the base.

17. A Gas torch with flame shaping elements as claimed in claim 14 wherein the base further comprises:

a bottom plate having an aperture therethrough;

a top plate having the gas ports formed therein for emitting gaseous fuel; and a volume defined between the bottom plate and the top plate acting as a manifold for receiving gaseous fuel and dispersing the gaseous fuel generally evenly through the gas ports.

* * * * *